US005322403A

United States Patent [19]

Herde

[11] Patent Number: 5,322,403

[45] Date of Patent: Jun. 21, 1994

[54] VERSATILE, MOVABLE PANEL AND UTILITY SUPPORT LIFT

[76] Inventor: Robert A. Herde, 28 Pippin La., Wappingers Falls, N.Y. 12590

[21] Appl. No.: 849,496

[22] Filed: Mar. 11, 1992

[51] Int. Cl.[5] ..... E04G 21/16

[52] U.S. Cl. ..... 414/11; 248/354.1; 248/910

[58] Field of Search ..... 414/11; 248/349, 354.1, 248/357, 910

[56] References Cited

U.S. PATENT DOCUMENTS

| | | | |
|---|---|---|---|
| 1,228,615 | 6/1917 | Stafford | 248/910 X |
| 3,222,031 | 12/1965 | Gormley | 248/354.1 X |
| 3,467,261 | 9/1969 | Jewell | 414/11 |
| 3,967,738 | 7/1976 | Winings | 414/11 |
| 4,027,802 | 6/1977 | Reynolds | 414/11 |
| 4,300,751 | 11/1981 | Delaney | 414/11 |
| 4,560,031 | 12/1985 | Dixon et al. | 414/11 X |
| 4,600,348 | 7/1986 | Pettit | 414/11 |
| 4,715,760 | 12/1987 | Browning | 414/10 |
| 4,733,844 | 3/1988 | Molloy | 414/11 |
| 4,928,916 | 5/1990 | Molloy | 414/11 |

*Primary Examiner*—Michael S. Huppert
*Assistant Examiner*—Janice Krizek
*Attorney, Agent, or Firm*—Joseph L. Spiegel

[57] ABSTRACT

Apparatus for moving construction material relative to a building frame includes a weighted, pivotable base, an extensible shaft projecting from the base, and a carrier assembly adjustable transversely of and pivotable relative to the shaft and including releasable grippers for holding construction material on the assembly, positioned on the shaft. The base has a non-slip exterior surface and a retractable caster housed therein. The shaft is extensible manually and includes a jacking mechanism for extending same incrementally. A spring on the shaft urges the construction material in contact with the building frame. The shaft is made up of telescoped tubular members, and a piston type seal to trap air is provided for dampening downward movement. A collapsible tripod mechanism provides additional support for the apparatus.

11 Claims, 13 Drawing Sheets

FIG. 3
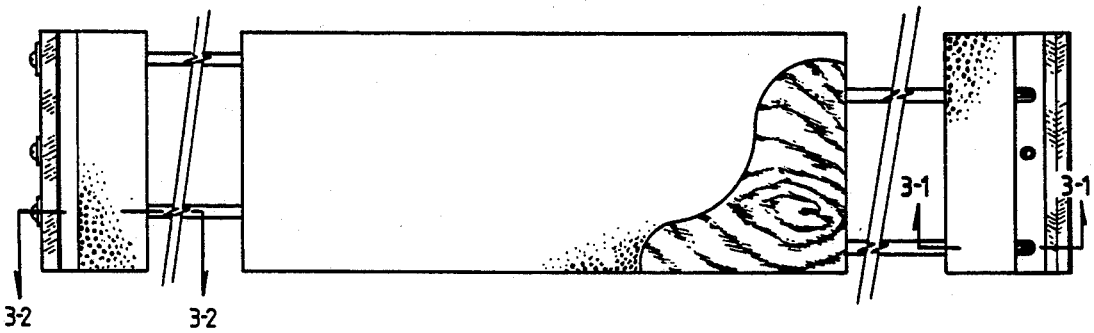
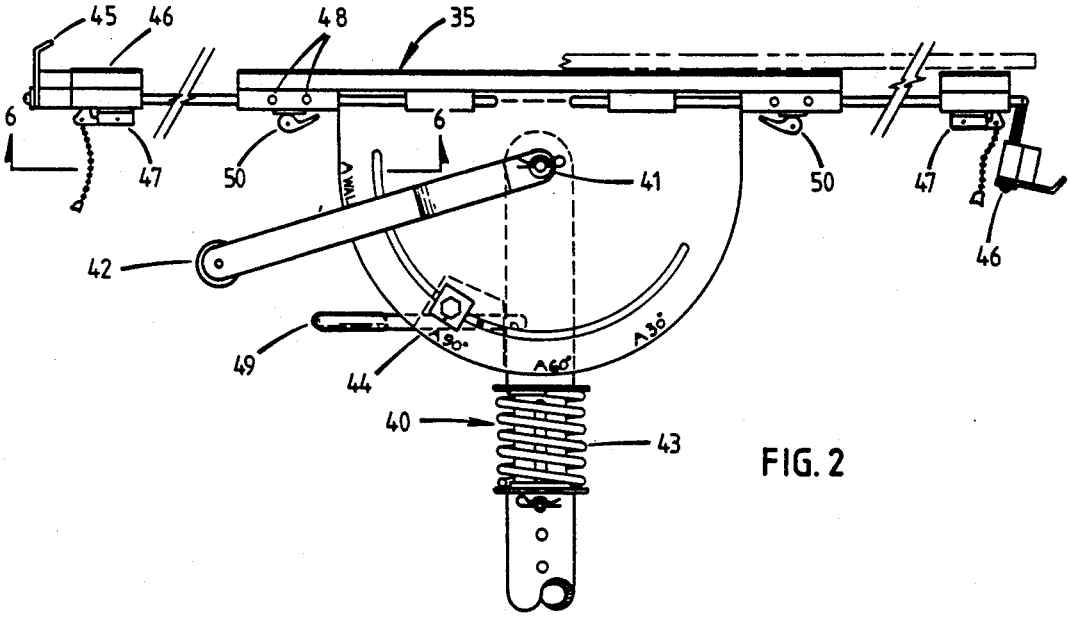
FIG. 2
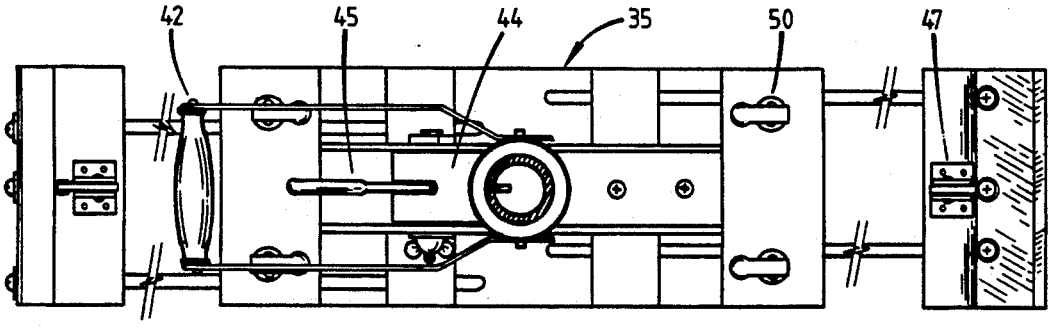
FIG. 4

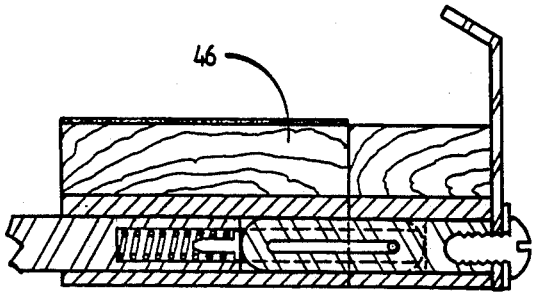
FIG.3-2
FIG.3-1
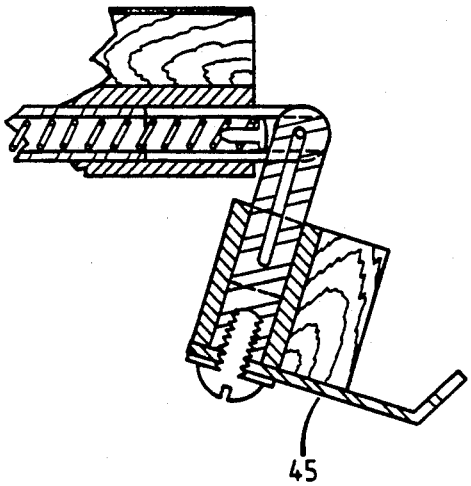
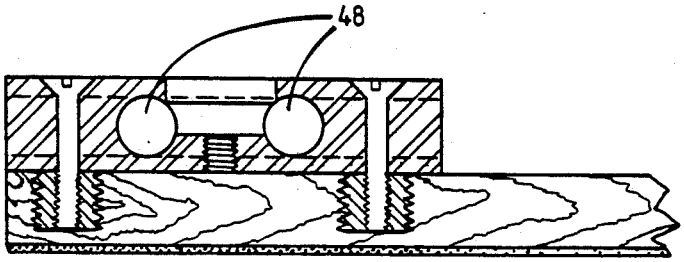
FIG.6-1
FIG.6-3
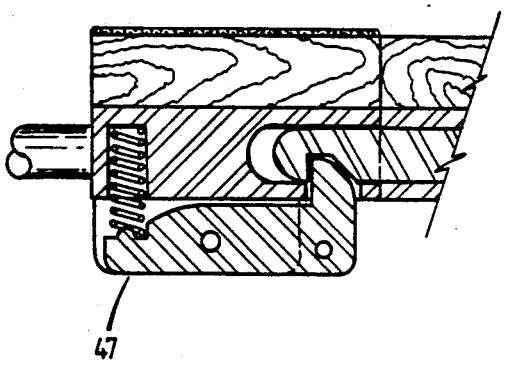
FIG.6-2
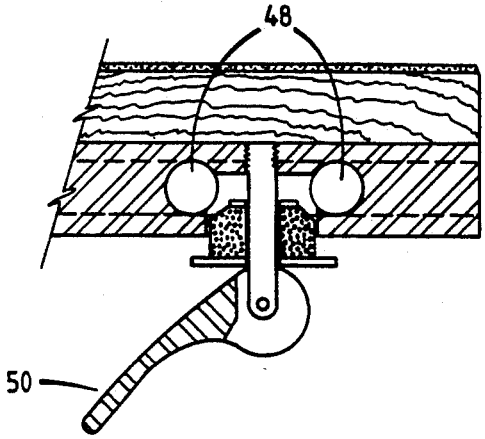

Fig. 5-1
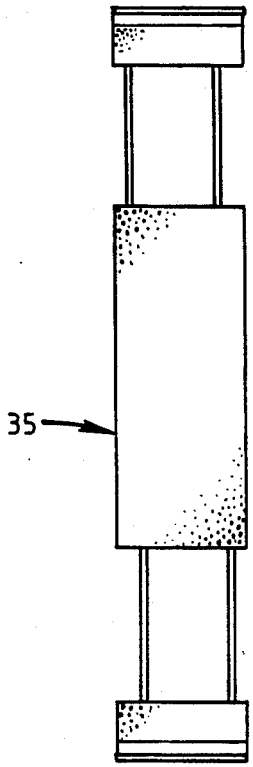
Fig. 5-2
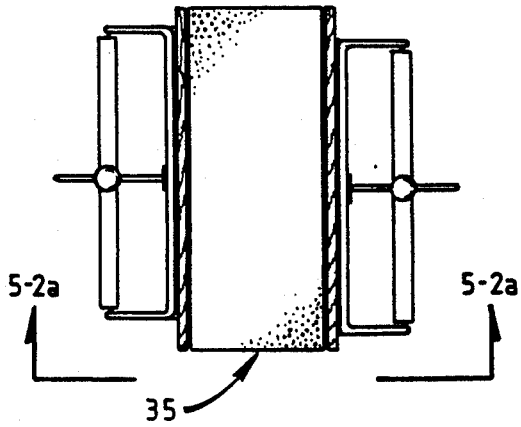
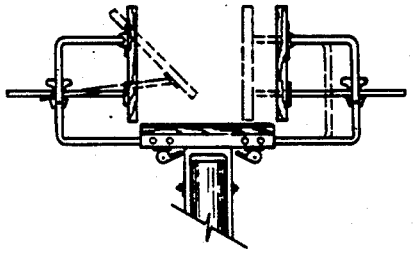
Fig. 5-2a
Fig. 5-3
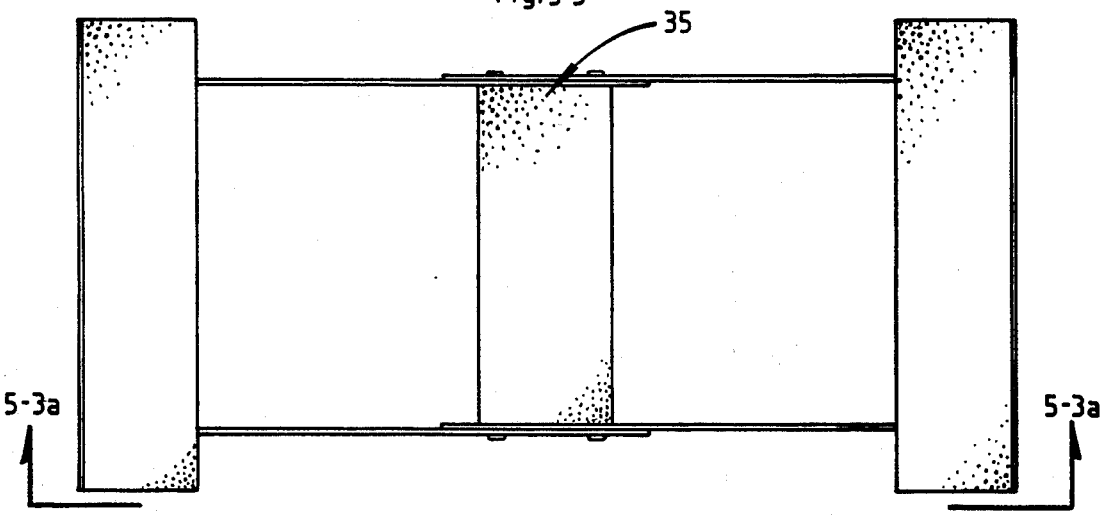
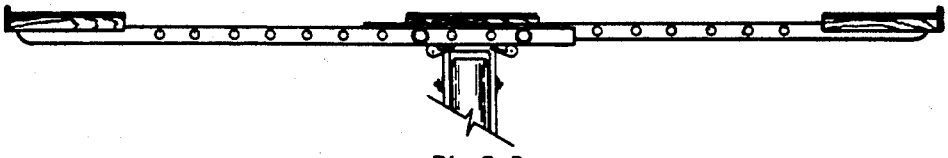
Fig. 5-3a

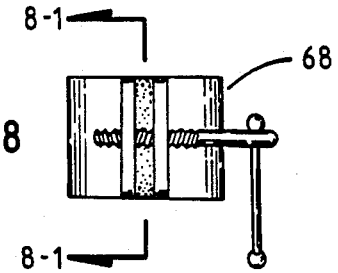
FIG. 8
FIG. 8-1
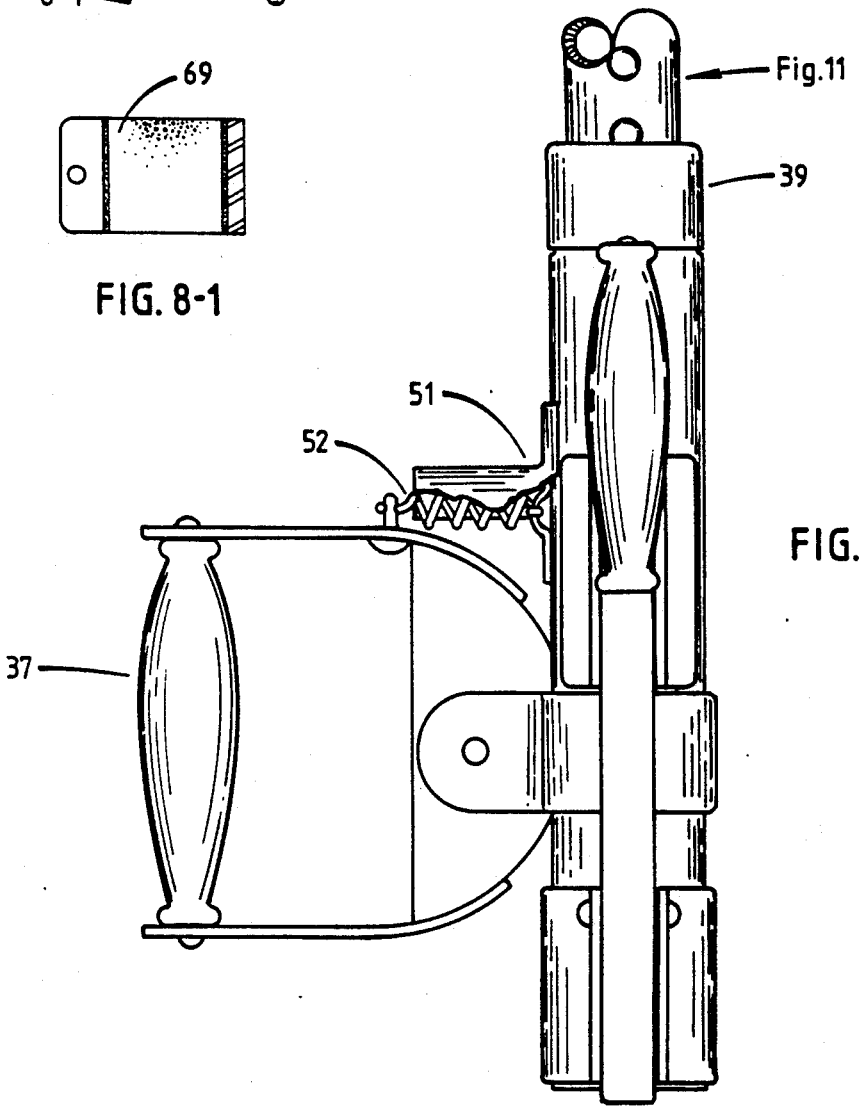
FIG. 9
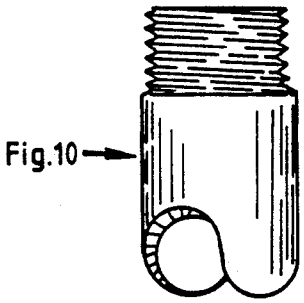

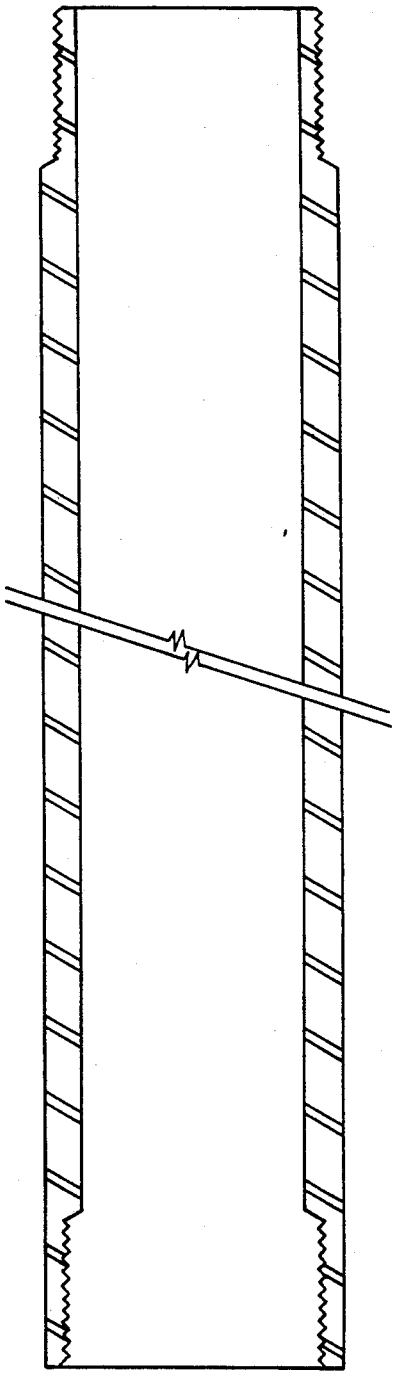
FIG. 10
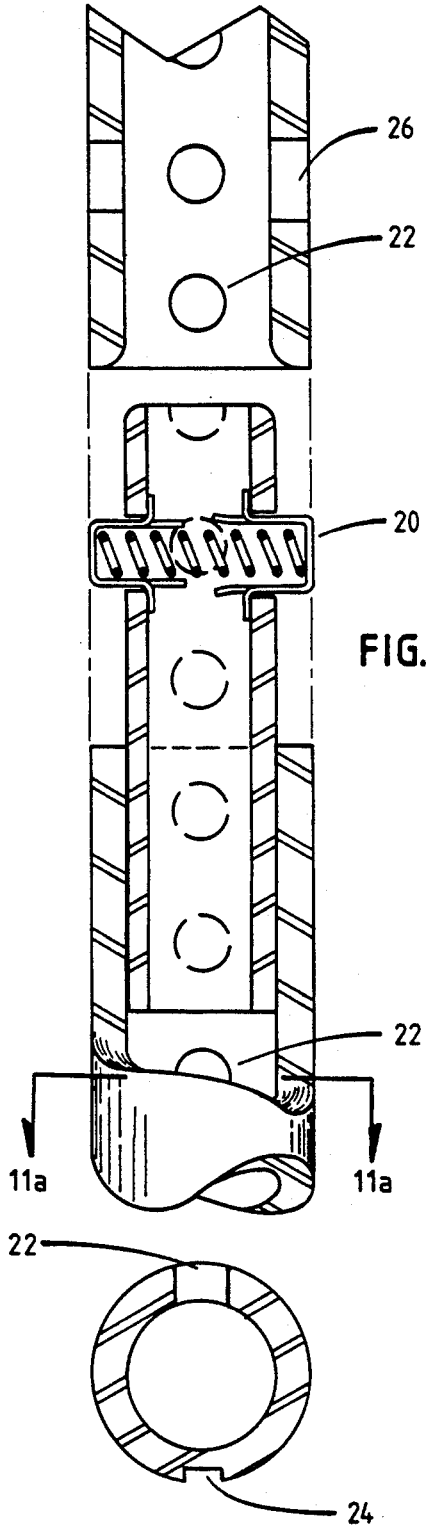
FIG. 11
Fig. 11a

FIG. 13
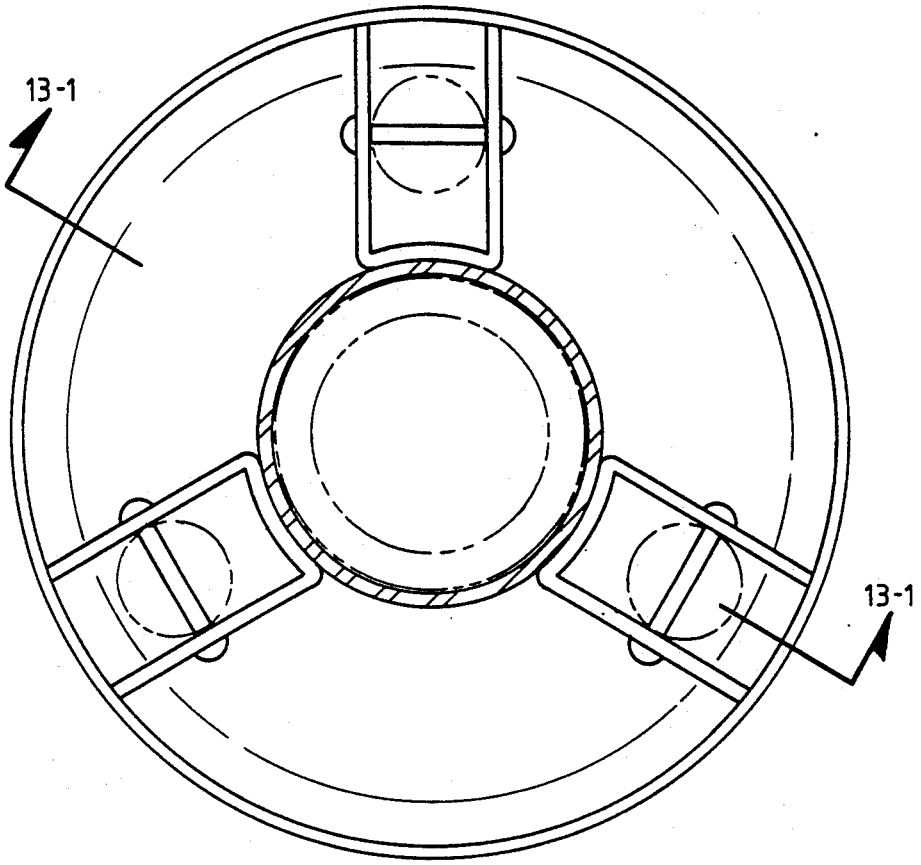
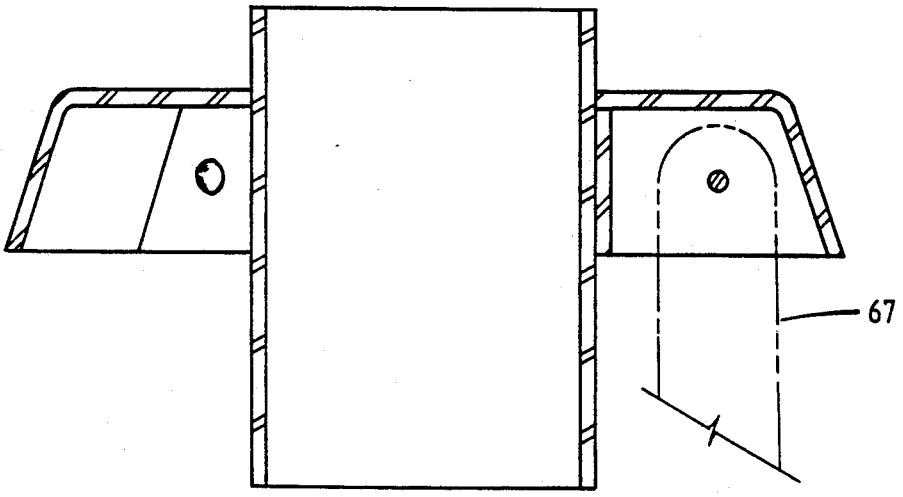
FIG. 13-1

FIG. 14
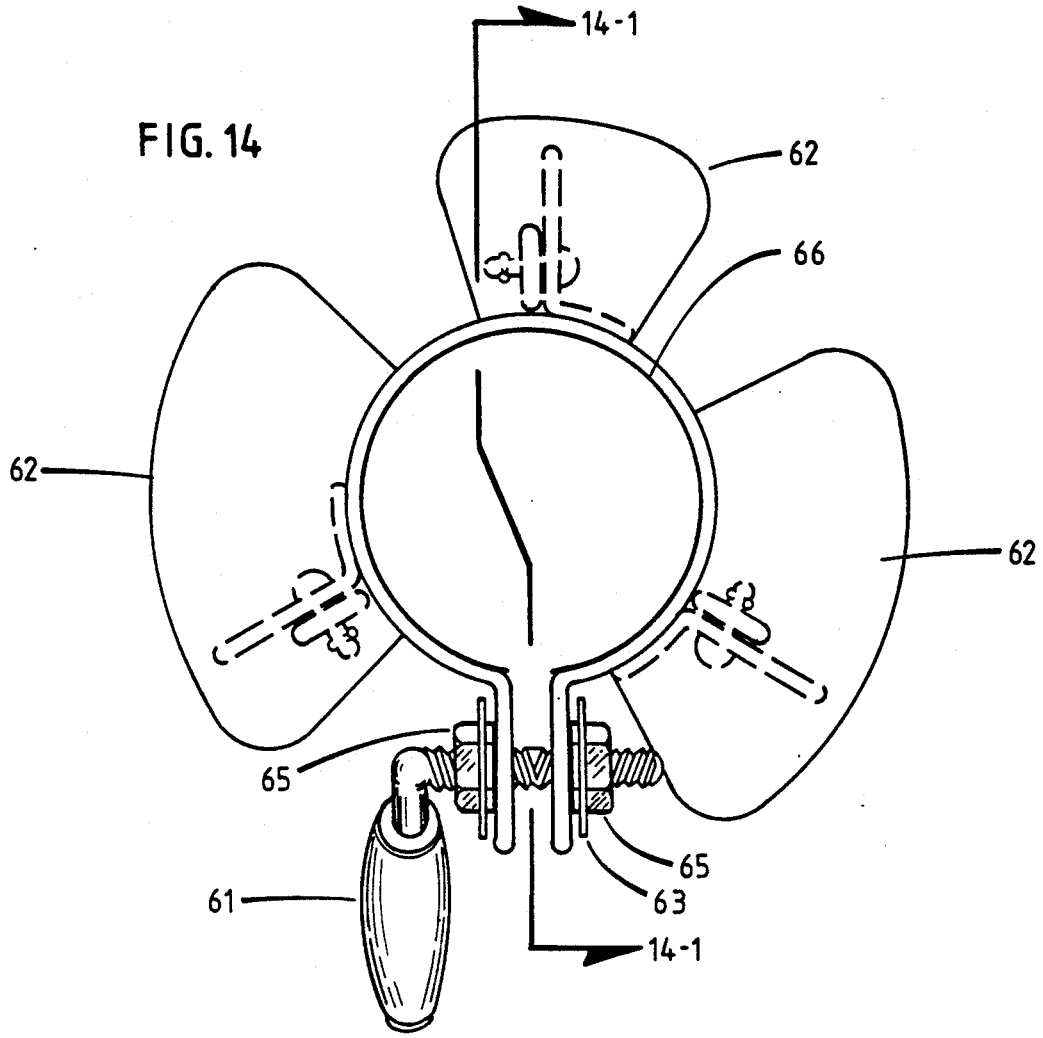
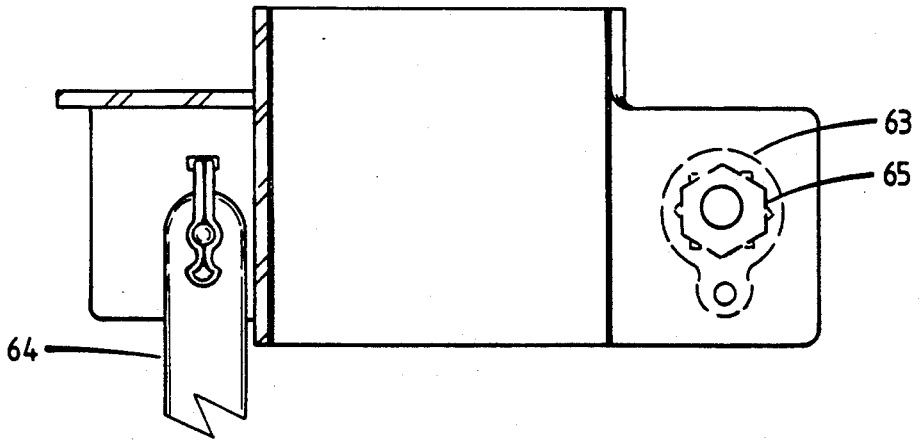
FIG. 14-1

VERSATILE, MOVABLE PANEL AND UTILITY SUPPORT LIFT

BACKGROUND OF THE INVENTION

This invention relates to the lifting and supporting, moving and positioning, then the holding in place of various building materials in a location where they can be secured or attached to a building's structure.

BACKGROUND DESCRIPTION OF PRIOR ART

In construction, a requirement has always existed for a tool or apparatus capable of lifting and supporting various building materials to be positioned for installation. Heretofore, many forms of suitable lifts have been provided to handle specific building material installation requirements. Most of these lifts exhibit one or more of the following limitations: They are cumbersome and are time consuming to operate. Many are non-portable and have various usable height restrictions. I offer as an example, U.S. Pat. No. 4,733,844 to Molloy (Mar. 29, 1988) and U.S. Pat. No. 4,928,916 to Molloy (Mar. 29, 1990). Although this sheet rock support offers some assistance to a person installing overhead panels, e.g.: Sheet Rock, it requires the installer to hold the panel against the overhead structure with one hand while grasping said sheet rock support and positioning it under said supported panel with the other hand. When said sheet rock support is in place, the installer must then use both hands and his foot to raise said sheet rock support and overhead panel to final install position under spring tension. This operation is burdensome and reduces the installer's stability which is needed to stabilize said sheet rock support and panel. In addition, said sheet rock support has no installer assist mechanical lift capabilities.

Some prior art lifts can be used efficiently on flat ceilings but not on sloping ceilings or on walls. In addition, some of these lifts are quite large and very heavy. This is the result of their design criteria to supply a lift for one person operation. However, all these lifts require two people to initially raise standard sized building materials, e.g.: sheet rock, to a predetermined loading height above the waist.

The following patents are mentioned here based on their design and preferred embodiment detail descriptions. They all have some aspect of their intended design that is similar to this invention. U.S. Pat. Nos. 4,928,916 to Molloy (May 29, 1990), 4,600,348 to Pettit (Jul. 15, 1986), 4,300,751 to Delaney (Nov. 17, 1981), 4,027,802 to Reynolds (Jun. 7, 1977) and 3,467,261 to Jewell (Sep. 16, 1969) dealing with apparatus for lifting and/or installing panel type building materials such as Sheet Rock or Wall Board. U.S. Pat. No. 4,715,760 to Browning (Dec. 29, 1987) describes a hoist for installing cabinets, ceiling frames and the like. Also a product currently being marketed called "Panel Lift", has most of the limitations mentioned above, e.g.: large footprint, heavy and requires the building materials be raised above the waist to initially load the lift. None of the prior art listed above or reviewed by me, had most of the present invention's capabilities and many had only one available capability, overhead support for panel type materials.

OBJECTS AND ADVANTAGES

Accordingly, a need exists for an improved lift or apparatus that is easy and quick to assemble and use, lightweight and portable. It must have a mechanical lifting mechanism and be capable of moving supported building materials to the final place of installation. In addition, this lift should be capable of installing building materials, e.g.: Sheet Rock, on flat or sloped ceilings, at relatively high or very low heights. It should also be efficient at installing said materials on walls, including recessed walls having a concrete block or foundation partly obscuring its base, as is found in most private dwelling basement type installations. The lift should be capable of being used in small or narrow areas, e.g.: closets, hallways and the like. Lastly, the lift should also be capable of being used for a variety of other supporting and holding tasks on a construction site.

Several objects and advantages of the present invention are:

(a) To provide a light weight, sectionalized, easy to use lift capable of raising, supporting and holding various building materials in place to facilitate fastening to building structures.

(b) To provide a lift with quick and easy to assemble sections which will result in the assembled configurations having a capability to access various installation heights.

(c) To provide a lift with a non-slip building materials holder or carrier assembly which is adjustable to accommodate any installation angle and with its adapters, can be used with various building materials.

(d) To provide a lift support assembly which will also be sectionalized for quick and easy assembly, with the resulting configurable capability of providing support at all required installation heights.

(e) To provide a lift with a weighted, non-slip, pivotable base section to facilitate operator assist with the initial lifting of panel type building materials, e.g.: Sheet Rock, from a supply location, at floor level, to an overhead or above the floor location.

(f) To provide a lift with controls that will allow rapid raising or lowering of supported building materials with a defaulted positive retention or detentable stop to ensure against inadvertent lowering of supported materials.

(g) To provide a lift with controls for precise mechanically assisted raising of building materials.

(h) To provide a lift which has the capability to move supported building materials.

(i) To provide a lift with a positive means for ensuring the support of heavy building materials accurately at a predetermined height, for long periods of time.

(j) To provide a lift with optional pneumatic operation and controls.

(k) To provide a lift which is fully collapsible for compact portability and can be stored in a carrying case for ease of transportation to a job site.

The objects and advantages of the present invention are to provide a wide range of operational capabilities and improvements over the above mentioned prior art. This will be accomplished by providing initial lift or raising assist for panel, e.g.: Sheet Rock, installations. Additionally, fast and speedy raising and lowering capabilities plus sturdy adjustable support for said utility lift are provided when supporting and holding building materials at required heights. Still further objects and advantages will become apparent from a consideration of the ensuing description and drawings.

DRAWING DESCRIPTIONS

FIG. 1 An elevational view of the Versatile, Movable Panel or Utility Support Lift. It serves as an index to additional detail drawings.

FIG. 2 A front view of the adjustable Carrier Assembly showing Carrier Detent Assembly, adjustable Panel Lift Gripper Assembly, Lift Handle and Carrier Support Spring.

FIG. 3 A top view of adjustable Carrier Assembly showing Panel Lift Grippers and Carrier Support Platform.

FIG. 3-1 Panel Lift Gripper hinged in open position.

FIG. 3-2 Panel Lift Gripper in closed position.

FIG. 4 A bottom view of adjustable Carrier Assembly further clarifying Carrier Detent and Locking mechanisms.

FIGS. 5-1, 5-2, 5-2*a*, 5-3 and 5-3*a* These drawings show the various adapters available for use with the Carrier Assembly.

FIG. 5-1 Panel or Sheet Rock Adapter.

FIG. 5-2 Pipe or building Beam Support Adapter. (See Note-A)

FIG. 5-2*a* A side view of the adapter depicted in FIG. 5-2.

FIG. 5-3 General Utility Support Adapter. (See Note-A)

FIG. 5-3*a* A side view of the adapter depicted in FIG. 5-3.

Note-A: The Posi-Lock Collar may be used with these adapters. (FIG. 8)

FIG. 6 A bottom view of Panel Carrier Assembly showing Gripper Hinge, Gripper Detent and Carrier Adapter Arm Latch details.

FIG. 6-1 Cross Sectional view of Carrier Adapter Arm Support Block.

FIG. 6-2 Cross Sectional view of Carrier Adapter Arm Latch.

FIG. 6-3 Cross Sectional view of Panel Gripper Detent Assembly.

FIG. 7 A front view of the Control Section showing Manual Jacking Mechanism, Lift Detent Cam and Upper Lift Shaft Seal Cap.

FIG. 7-1 Cross Sectional view of Control Section showing Anti-Twist Key and Upper Lift Shaft Seal Cap.

FIG. 7-2 Wall Installation Plug.

FIG. 7-2*a* An end view of the wall installation plug depicted in FIG. 7-2.

FIG. 8 A front view of Posi-Lock Collar. The Posi-Lock Collar can be used with Carrier adapters when holding heavy loads for long periods of time.

FIG. 8-1 Cross sectional view of Posi-Lock Collar showing non-slip coating.

FIG. 9 A side view of the Control Section showing the Lift Detent Cam mechanism and Carrying Handle.

FIG. 10 A cross sectional view of Outer Lift Shaft sections showing the recessed threading scheme used for coupling of said sections.

FIG. 11 A cross sectional view of Inner Lift Shaft showing Spring Biased Coupling Latch mechanism, Jacking Ports and Anti-Twist Channel.

FIG. 11*a* An end view of the inner shaft depicted in FIG. 11.

FIG. 12 A cross sectional view of said Utility Lift Pivot Base showing the Retractable Caster mechanism, Inner Lift Shaft Seal and Bottoming Cushion, Tri-Pod Anchor Flange, Pivotal Base Weight and Pneumatic Port.

FIG. 13 Bottom view of Tri-Pod Pivot Collar showing Tri-Pod Support Leg pivot points.

FIG. 13-1 Cross sectional view of Tri-Pod Pivot Collar.

FIG. 14 Top view of Tri-Pod Locking Collar showing Lift Wings and Lock Handle with threading scheme for half-turn operation.

FIG. 14-1 Cross sectional view of Tri-Pod Locking Collar showing non-slip coating plus Lock Handle Adjust Nut and Adjust Ring details. A typical Tri-Pod Limiter Link quick connect attachment detail is included.

FIG. 15 Side view of adjustable Tri-Pod Caster Assembly.

FIG. 16 Typical view of Tri-Pod Support Leg coupling.

FIG. 16-1 Cross sectional view of Tri-Pod Support Leg coupling.

FIG. 17 A sequential drawing showing typical application of said Utility Lift during CEILING type panel installations, while loading, pivoting and lifting then holding or supporting in place for fastening to building's structure.

FIG. 18 A sequential drawing showing typical application of said Utility Lift during WALL type panel installations, while loading, pivoting and lifting then holding or supporting in place for fastening to building's structure.

NUMERICAL REFERENCE LIST

20 Spring Loaded Coupling (Inner Lift Shaft)
21 Wall Installation Plug
22 Jacking Ports
23 Wall Installation Plug Storage
24 Anti-Twist Channel
25 Rubber Covered Pivotal Base
26 Inner Lift Shaft Coupling Ports
27 Weight-Pivotal Base
28 Retractable Caster
29 Inner Lift Shaft Bottoming Cushion
30 Pneumatic Input/Output Port
31 Retractable Caster Pedal Latch
32 Tri-Pod Anchor Flange
34 Inner Lift Shaft Seal
35 Carrier Assembly
36 Manual Jacking Mechanism
37 Lift Detent Cam and Carrying Handle
38 Anti-Twist Key
39 Outer Lift Shaft Seal Cap
40 Inner Lift Shaft Carrier Support Section
41 Carrier Attach Pin
42 Carrier Lift Handle
43 Carrier Support Spring
44 Carrier Detent Assembly
45 Panel Gripper Plates
46 Panel Gripper Assembly
47 Panel Gripper Detent
48 Carrier Adapter Arm Ports
49 Carrier Detent Release Lever
50 Carrier Adapter Arm Latch
51 Lift Detent Spring Dust Cover
52 Lift Detent Spring
53 Manual Jacking Block
54 Manual Jacking Block Link
55 Manual Jacking Block Link Guide
56 Manual Jacking Handle 57 Manual Jacking Handle Mounting Bracket
58 Manual Jacking Block Dowel
59 Manual Jacking Block Spring
60 Tri-Pod Caster Latch Hook
61 Tri-Pod Lock Handle
62 Tri-Pod Lock Collar Lift Wings
63 Tri-Pod Lock Handle Adjust Ring
64 Tri-Pod Limiter Link
65 Tri-Pod Lock Handle Adjust Nut
66 Tri-Pod Lock Collar Non-Slip Coating
67 Tri-Pod Support Legs
67*a* Tri-Pod Support Leg Coupling
68 Posi-Lock Collar
69 Posi-Lock Non-Slip Coating

DESCRIPTION OF PREFERRED EMBODIMENTS

The Preferred Embodiments of this invention are shown in drawings FIG. 1 thru FIG. 16, inclusive. The Versatile, Movable Panel or Utility Support Lift, as shown in (FIG. 1), in accordance with this invention is shown in an operating position with Tri-Pod supports extended and Panel or Sheet Rock adapter installed. This said Utility Lift is intended to provide assistance in the initial lifting and installation or removal of building materials.

For purposes of simplified functional descriptions, the Panel or Sheet Rock Carrier (FIG. 5-1) applications are referenced throughout this section. This said Utility Lift would be carried to an installation site, fully collapsed and housed within its carrying case (not shown). It would then be assembled to access the required installation height and have the correct Carrier Adapter in place to handle building material being installed. Said Utility Lift consists of two shafts made from thick wall telescoping tubing with outer (FIG. 10) and inner (FIG. 11) tubes in varying length sections which when coupled form the Outer Lift and Inner Lift Shaft assemblies. The outer tubing sections are coupled together using standard coarse pitch or acme type threading (FIG. 10) arranged to keep the inner and outer tubing surfaces flush to facilitate an unobstructed cylindrical bearing surface. The inner tubing sections (FIG. 11) are coupled via a Spring Loaded Coupling (20) mechanism which when seated correctly in its coupling ports (26) will result in an unobstructed cylindrical bearing surface which allow for controlled movement within the Outer Lift Shaft.

Figures 1, 7:
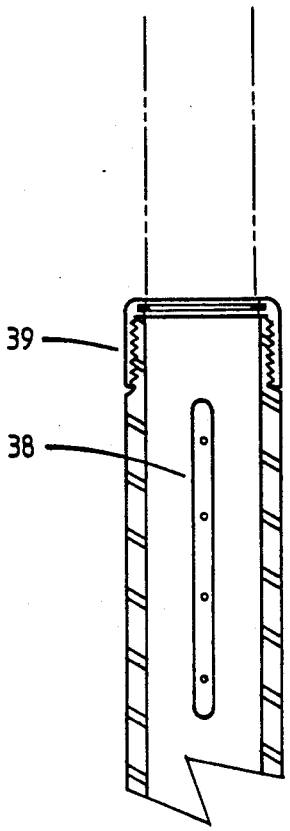
Figures 2, 7:
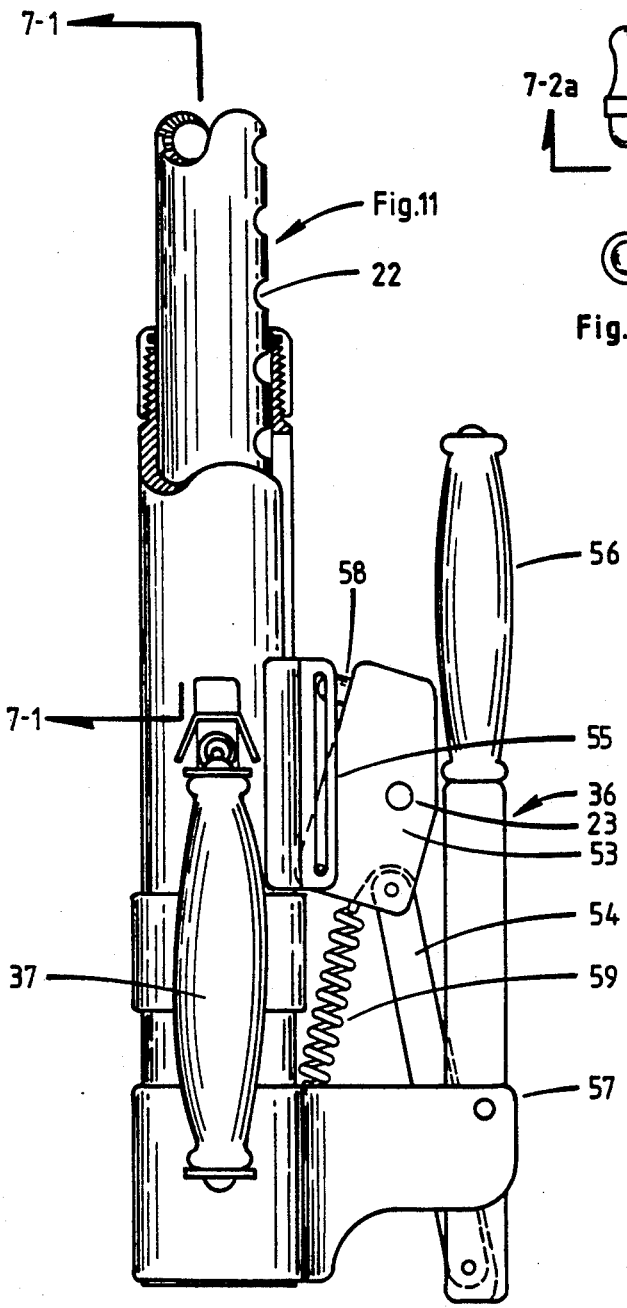
Figure 7:
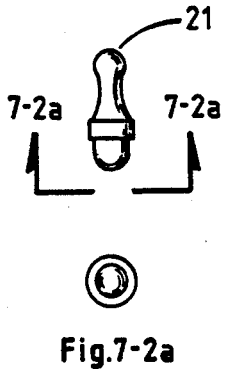
Figure 12:
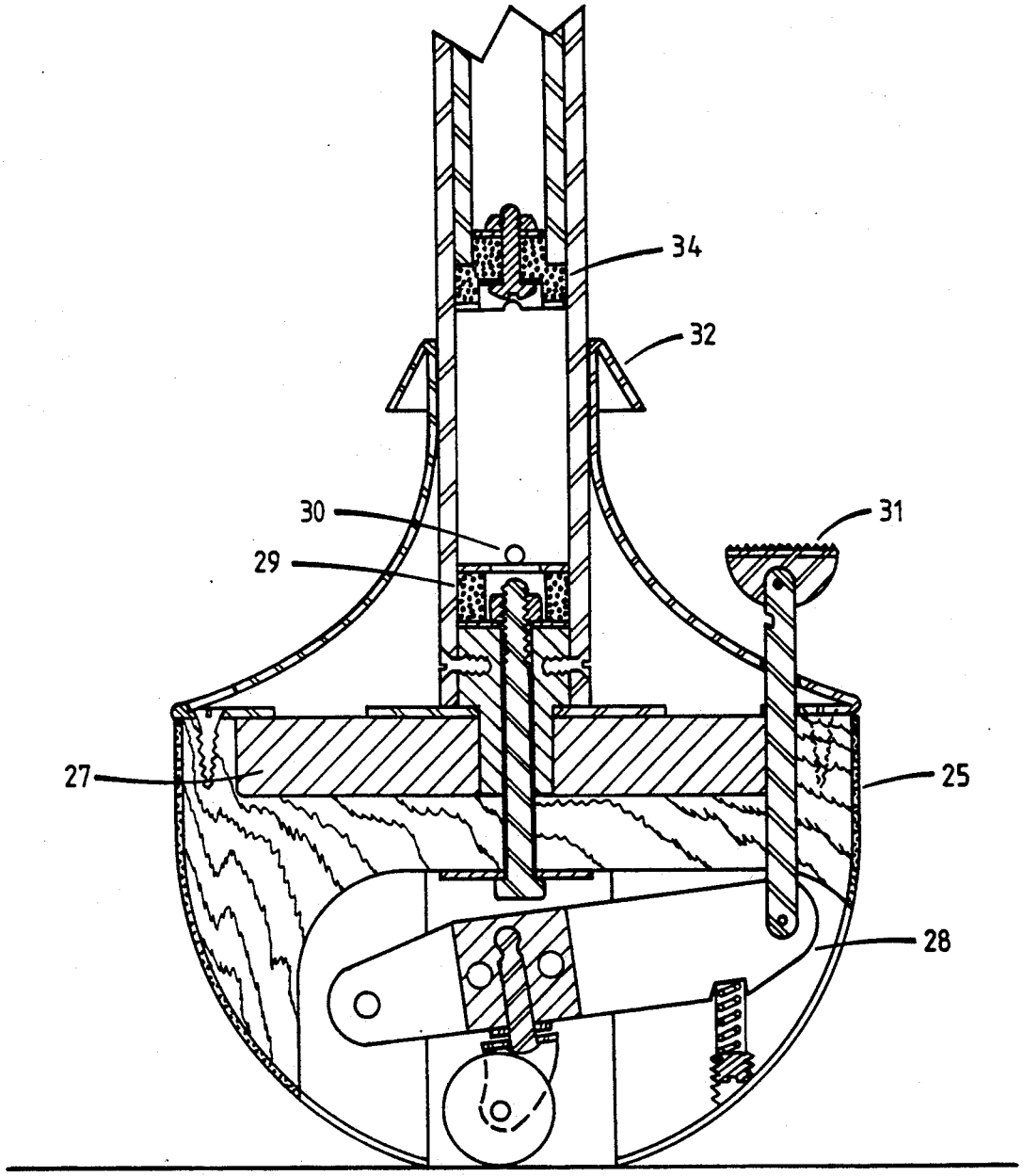
Figure 16:
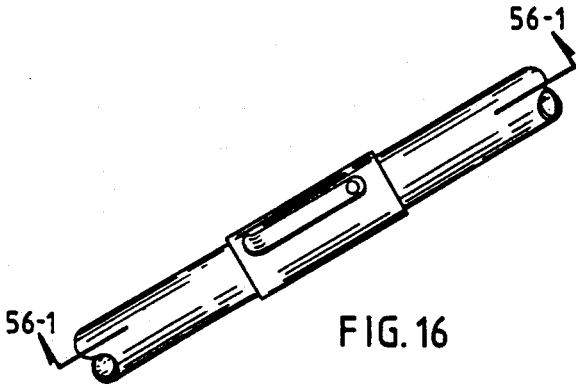
Figures 1, 16:
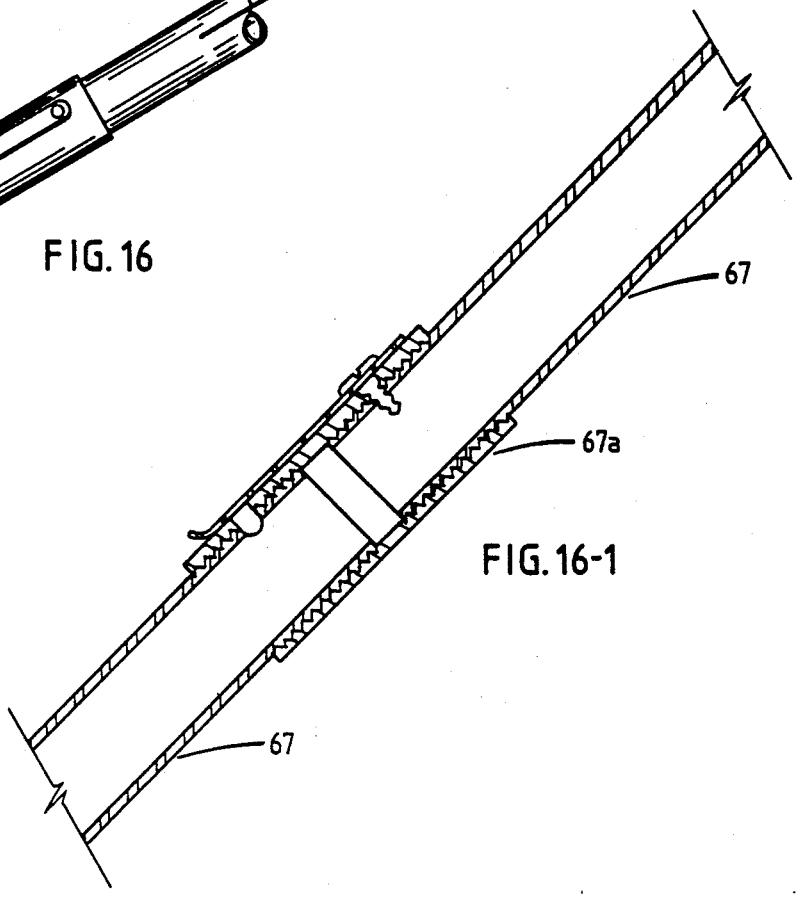
Figure 15:
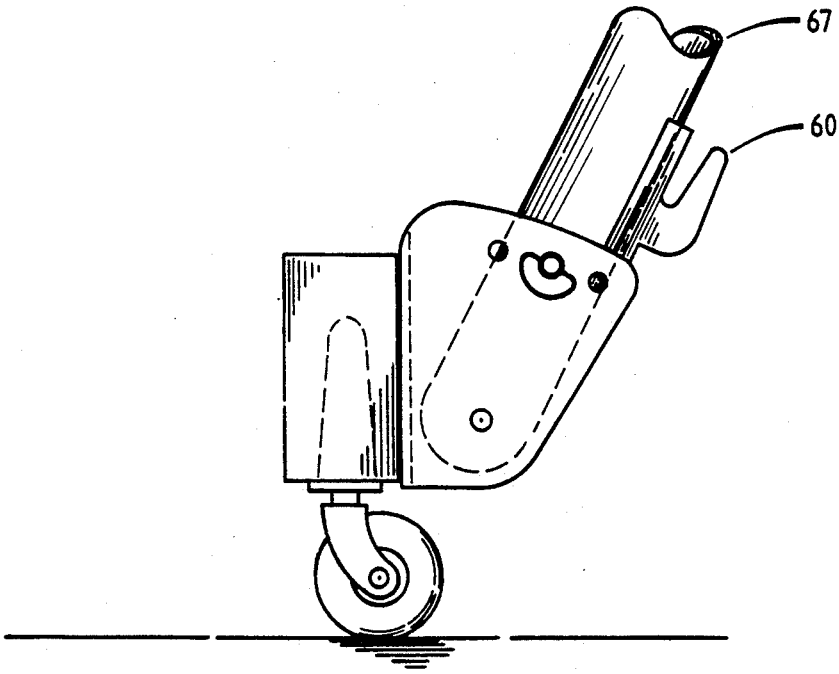

The Outer Lift Shaft cylindrical sections are divided as follows: A. A weighted (27) base section (FIG. 12) which contains a Rubber Covered (25) pivotable Base, a Retractable Caster mechanism (28), Inner Tube Bottoming Cushion (29), Air Escape Inlet Port (30) and Anchor Flange (32) used for holding the Tri-Pod Support Legs while in a closed position. B. Outer Lift Shaft sections (FIG. 10) in various lengths to be used in the assembly of said Utility Lift to obtain overall operational heights of from approximately one meter to 4 meters. C. A Control Section (FIGS. 7 and 9) which contains the Manual Jacking mechanism (36), Detent Cam and Carrying Handle (37) and Anti-Twist Key (38) which is used with the Anti-Twist Channel (24) running lengthwise on all Inner Lift Shaft sections. (FIG. 11) to prevent the Inner Lift Shaft from turning within the Outer Lift Shaft. This also serves to keep the manual Jacking Ports (22) aligned. The Outer Lift Shaft Seal Cap (39) is shown in FIG. 7 and will be installed on top-most exposed threaded end of Outer Lift Shaft configuration.

The upper-most Inner Lift Shaft Carrier Support section (40) is a limited movement, spring coupled telescoping tube which is connected to the Carrier Assembly (FIG. 2) via the Carrier Attach Pin (41). This said Inner Tube section (40) is used to support the Carrier Assembly and apply controlled holding tension, via the Carrier Support Spring (43), on material being supported and held against the building structure. The bottom most Inner Lift Shaft contains the Inner Lift Shaft Seal (34) which is designed to be used as a piston type seal to trap air for dampening purposes during lowering or collapsing of the Inner Lift Shaft within the Outer Lift Shaft. It also provides the necessary seal to trap injected air during pneumatic lift or raising operation.

The Carrier Assembly (FIG. 2), including the Carrier Lift Handle (42) can be readily removed for transport purposes by removal of the Carrier Attach Pin (41). The Carrier Assembly (FIG. 2) is adjustable from zero degrees (Vertical), for Wall and ninety degrees (Horizontal) for flat ceiling type installation activities with the use of the Carrier Detent Assembly (44). By operating the Carrier Detent Release Lever (49), the Carrier Assembly will be unlatched and allowed to pivot towards the zero degree position. The Panel or Sheet Rock Adapter Gripper Assemblies (46) with their adjustable Panel Gripper Plates (45) will pivot away from the supported material when the Gripper Detent (47) is operated allowing unobstructed Panel mating.

All attachable Carrier Adapters are installed on the Carrier Assembly (35) by inserting the adapter arms into the Carrier Support Ports (48), operator adjusted or positioned, then held in place by the Carrier Adapter Arm Latches (50). The Carrier and Panel Gripper assemblies (46) are comprised of rubber coated solid core plywood, or other suitable materials, of sufficient thickness. This design eliminates electrical shock hazards.

The control Section (FIGS. 7 and 9) houses a one-way clutch or Detent Cam and Carrying Handle (37) which is designed to allow lift or raising, via the operator or by use of the Manual Jacking mechanism (36) in an upward direction, only. The Detent Cam is designed using a fixed radius wood block, or other suitable material. The camming end of said block is contoured to fit the Inner Lift Shaft's outside radius. This said Block also provides for the attachment of the Carrying Handle. To obtain the camming action, the Detent Cam pivot axis is offset approximately 1 centimeter downward from the cam radius origin or circular center point.

When the lifting forces are removed, the downward movement of the Inner Lift Shaft together with the spring tensioned (52) induced frictional bonding of said Shaft to the contoured cam surface, causes said cam to pivot downward with said Shaft. This downward movement of the Detent Cam, pivoting on its offset axis pivot shaft, results in a directly proportional pressure and anti-slide frictional resistance between the Inner Lift and Outer Lift Shafts preventing the Inner Lift Shaft from continued movement in a downward or collapsing direction. A non-slip coating, or other device, may be applied to the inside wall of the Control Section, adjacent to the Lift Detent opening. This will increase the anti-slide frictional resistance, if required. The Lift Detent Spring (52), which could be made adjustable to accommodate various loads, plus the camming angle of the Lift Detent, are designed to give maximum holding force while allowing for easy and unobstructed lifting or raising of building materials. A Dust Cover (51) is provided to prevent dust from entering the Detent Cam opening. A Posi-Lock Collar (68) which contains a Non-Slip Coating (69) is also provided for Inner Lift Shaft (FIG. 8) positive locking purposes, when required.

The Manual Jacking mechanism (36) consists of a Jacking Block (53) and Return Spring (59), Lift Block Link (54), Block Guide (55), Jacking Handle (56) and Mounting Bracket (57). When the Jacking Handle (56) is lowered to the operating position, the Jacking Block (53) is cammed under spring tension (59) inward to contact the Inner Lift Shaft. The Jacking Block contains a Jacking Dowel (58) which will enter the Jacking Ports (22) located on the Inner Lift Shaft and impart positive leveraged lifting force to said shaft as the Jacking Handle (56) is pushed in a downward direction. Releasing the Jacking Handle (56) will allow the Jacking Block (53) to pivot outward, away from the Inner Lift Shaft and be pulled down via the Jacking Block Spring (59) returning the Jacking Handle to its normally stored position. Approximately 1 to 6.5 centimeter increments of lifting distance is possible, with preferred embodiments, when using the Manual Jacking mechanism (36) for lifting or raising the Inner Lift Shaft (FIG. 9). Said Jacking Mechanism would also be used to apply holding force, via Carrier Support Spring (43) tension, for final positioning of building materials. A Wall Installation Plug (21) is provided for insertion into Jacking Ports (22) to prevent Inner Lift Shaft movement during initial positioning of said Utility Lift, on wall installation type activities.

Tri-Pod Support Legs are also assembled by screwing them into the respective detentable coupling (67*a*), until detent locks. The purpose of this detent is to align and hold said Legs in position for correct Tri-Pod Adjustable Caster operation. To disassemble Tri-Pod Support Legs, lift-up on the detent to enable said Legs to be unscrewed. The Tri-Pod Assembly is designed to stabilize said Utility Lift while being used to support and hold in place, various building materials. Once Said Utility Lift has been pivoted to an upright position, with or without supporting a load, as with building material removal, the Tri-Pod Lock Handle (61), located on the Tri-Pod Locking Collar (FIG. 14) can be rotated downward to release or unlatch the Tri-Pod Assembly.

The Tri-Pod Assembly moves downward towards the Tri-Pod Anchor Flange (32) allowing the Tri-Pod Limiter Links (64) to pivot the Tri-Pod Support Legs (67) in an outward direction to apply support. The Tri-Pod Support Legs (67) and the Limiter Links (64) can be configured at assembly using various length pieces to accommodate any required installation height of said Utility Lift. Although said Utility Lift is designed to operate with or without the Tri-Pod Support Assembly, most overhead building material installation activities would benefit from their use.

The Tri-Pod Assembly is positioned during installation on said Utility Lift by rotating the assembly to a position of minimal interference with said Utility Lift operator when Tri-Pod Support Legs (67) are being opened and extended. (See FIG. 1) The Adjustable Tri-Pod Caster assemblies (FIG. 15) allow the Tri-Pod Support Legs to extend fully and when used with the Retractable Caster (28), contained in the Rubber Covered Pivotal Base (25), will allow for transporting of supported materials from a loading zone to an installation zone. Once the supported materials have been located in the installation zone, the Retractable Caster (28) can be released by pressing down and outward on the Retractable Caster Pedal Latch (31) to lower the non-slip Rubber Covered Pivotal Base (25) to hold said Utility Lift firmly in place.

Tri-Pod Lock Collar (FIG. 14) Lift Wings (62) are provided for operator use in retracting the Tri-Pod Support Legs (67) and to facilitate the locking of the Tri-Pod Assembly in its transportable position. This is accomplished by pulling up on the Tri-Pod Lock Collar Lift Wings (62) until Tri-Pod Caster Latch Hooks (60) engage the Tri-Pod Anchor Flange (32) restricting further upward motion. While applying upward pressure on said Lift Wings (62), rotate the Tri-Pod Lock Handle (61) upward to lock or latch the Tri-Pod Assembly in its stored position. The Tri-Pod Lock Collar (FIG. 14) Lock Handle (61) is designed using right and left hand coarse pitch threading to provide rapid opening or closing of said Collar when Lock Handle (61) is operated. An adjustment is provided on the Lock Handle (61) for Lock Collar slide clearance to the Outer Lift Shaft. An Adjustment Ring (63) is provided for retention of Lock Handle Nuts (65). The Tri-Pod Lock Collar has a friction type Rubber Liner (66) or coating to facilitate a positive grip when latched.

The foregoing disclosed embodiment is an illustrative representation of the preferred invention. It is understood that this invention is not limited to the precise embodiment detailed herein and in the drawings. Various changes or modifications may occur, by those skilled in the art, and falling within the scope of this invention.

OPERATION OF INVENTION

Although the Versatile, Movable Panel or Utility Support Lift is designed to be used with or without Tri-Pod support, one person, with the assist of two said Utility Lifts, fitted with Tri-Pods, can raise said panel over his head and have it supported and stabilized. The operator is then free to perform other tasks which could include moving the supported panel, via the supplied casters, from the supply or loading place to the installation place.

The panel then can be elevated, quickly by hand or pneumatics, and fine positioned with cushioned spring pressure applied to hold the panel in place for fastening to the building structure. Final or fine positioning of the supported material can be done rapidly by moving or pivoting said Utility Lift while standing on the floor or by pushing the material, while on the ladder, preparing to fasten the material to the structure. The panel can quickly and easily be lowered, if necessary, for rework or refit and raised into position again. After the supported building material has been fastened, said Utility Lifts are quickly and easily lowered or collapsed to a portable configuration and carried back to the material supply point.

Initial Set-Up: (Sheet-Rock Installation)

Figure 1:
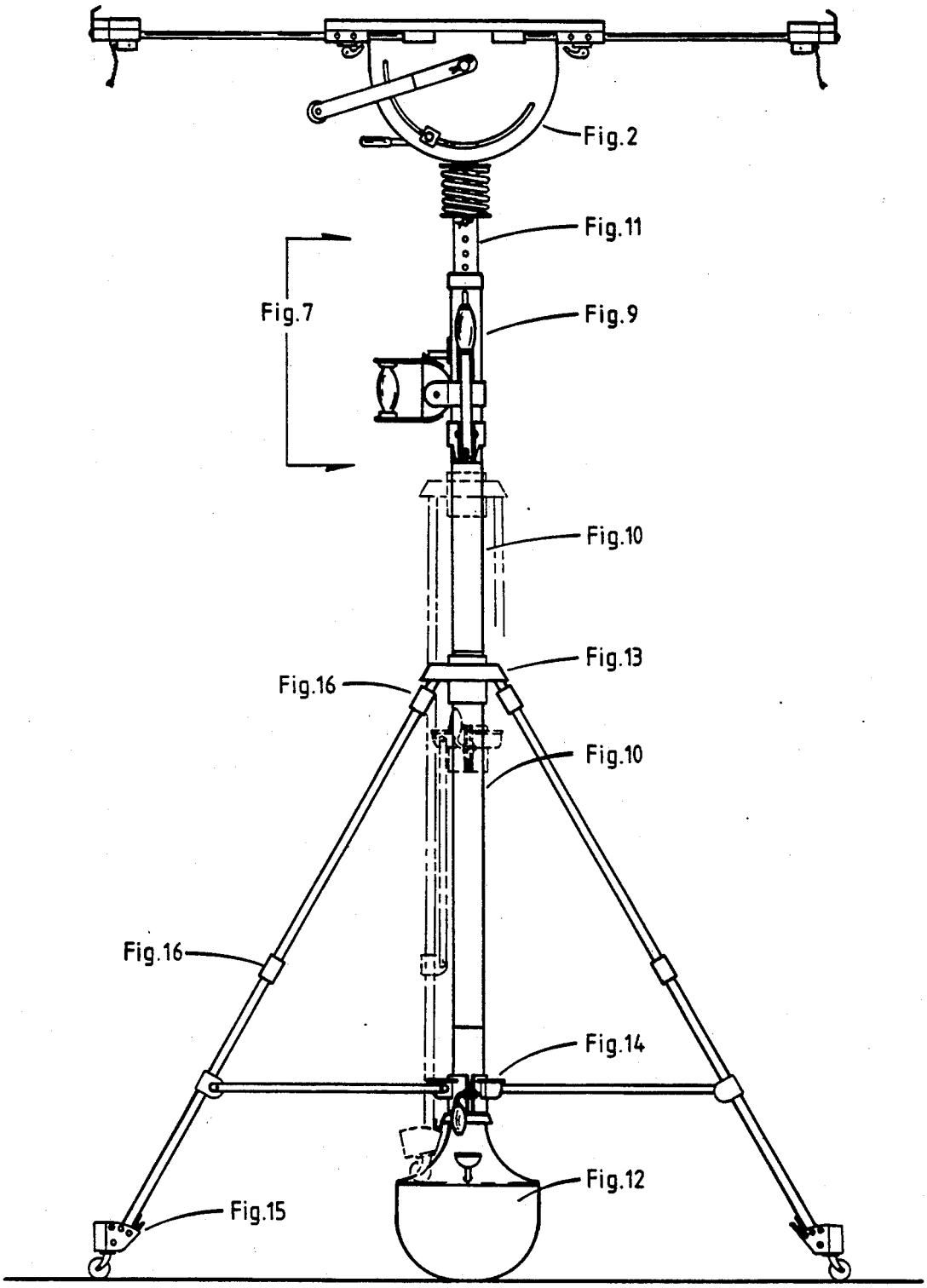
Figure 6:
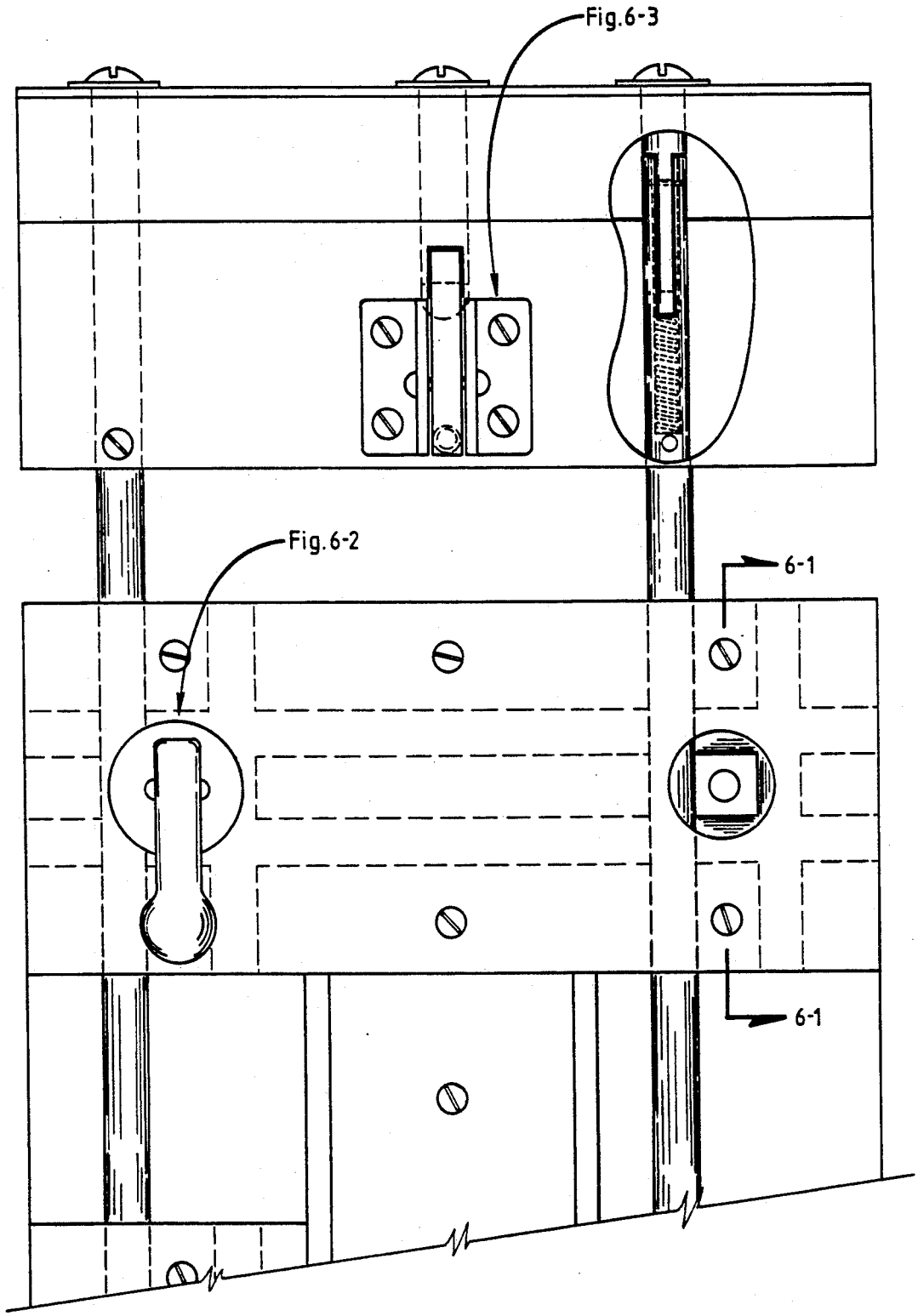

1. Assemble said Utility Lift Outer and Inner Lift Shaft sections for required installation height. Assemble Tri-Pod Assembly to fit said Utility Lift configuration. Install Tri-Pod Assembly on said Utility Lift.
2. Assemble Carrier Assembly (35) and Carrier Lift Handle (42) on Inner Lift Shaft Carrier Support section (40) using Carrier Attach Pin (41). Attach Panel or Sheet Rock adapters (FIG. 5-1).

Figure 17:
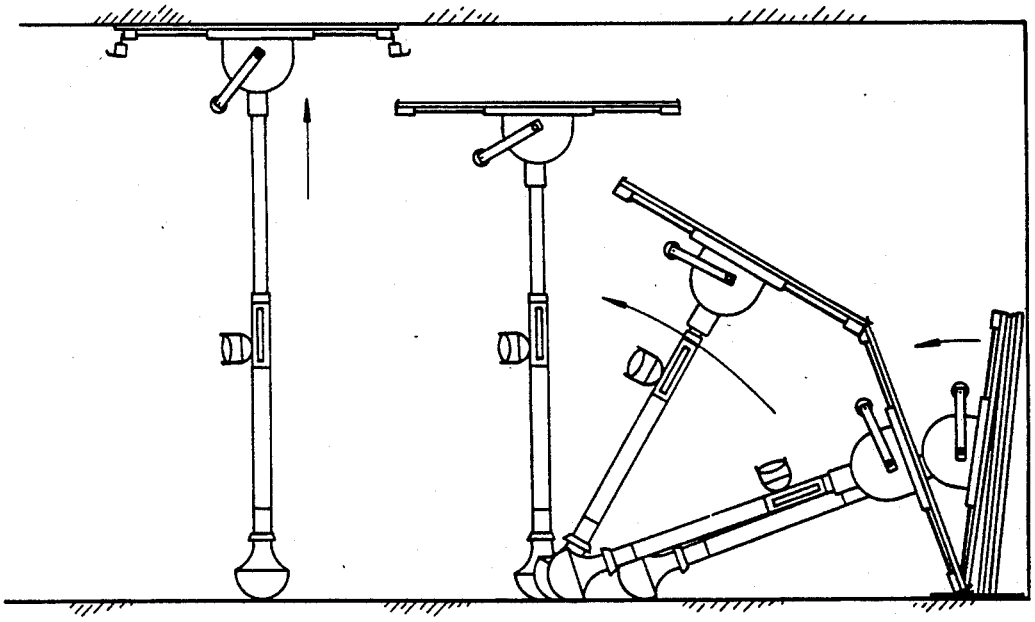

3. If installing Sheet-rock or Paneling, for best results have sheets stacked length-wise with finished side facing out. Have stacked sheets elevated and supported on pieces of scrap material. (FIG. 17) Space these supports to facilitate ease in positioning the Carrier and Gripper assemblies (46).
4. Adjust bottom Gripper Arms (46) for correct sheet width of material being installed and lock in place by closing the Carrier Adapter Arm Latches (50). Ensure correct Gripper Plates (45) are adjusted, on Gripper assemblies, for sheet thickness being used.

Figure 18:
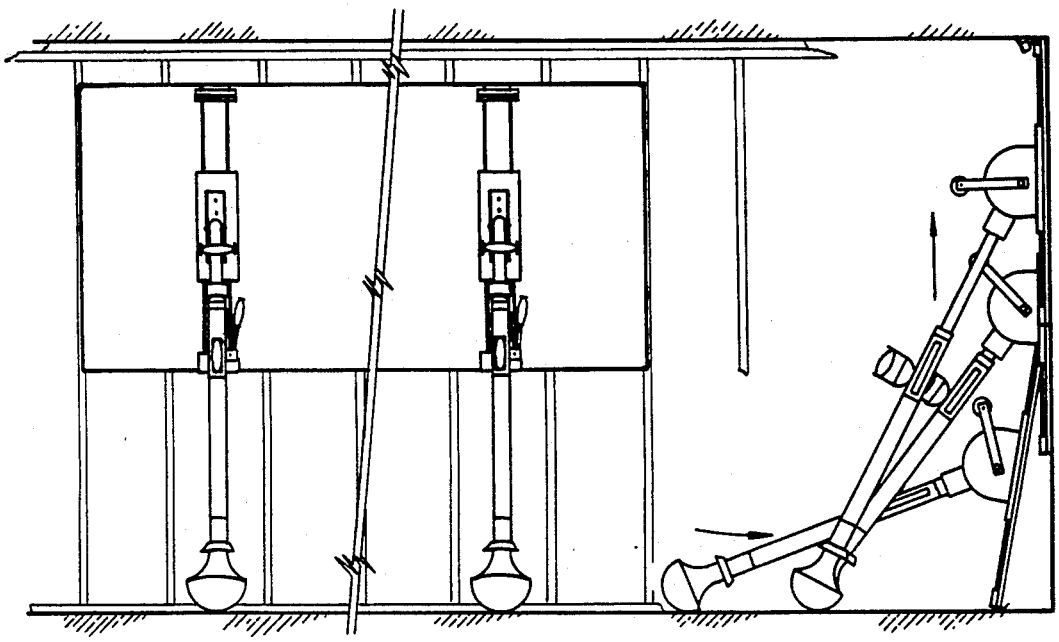

Ceiling Installations (Sheet-Rock or Paneling):

1. Reference FIG. 2: Set Carrier Detent Block (44) to desired latch angle. e.g.: 90 degrees for flat ceilings, 15 degrees thru 60 degrees for sloped ceilings.
2. Ensure Lift is fully collapsed with required number of Outer Lift and Inner Lift Shaft extensions installed, as required, to reach ceiling height. (FIGS. 10 and 11)
3. Position Lifts in front of sheet-rock. (FIG. 17) Note: One Lift will work with thin or less than full size sheets using the General Utility Support (FIG. 5-3) and Panel or Sheet Rock Adapters installed together. For best results on one-man installations or for use with thick or heavy sheets, two Lifts are recommended. For sheets exceeding 8' in length, add one additional Lift for each 4' increase in length. i.e.: 12' sheets require 3 Lifts. (FIG. 18)
4. Adjust bottom Gripper Assembly (46) to center Carrier Assembly (35) on sheet to be installed. Engage Carrier Adapter Arm Latches (50) to latch bottom Gripper Assembly at this adjustment.
5. Place sheet on bottom Gripper Assembly (46) and lower Top Gripper Assembly (46) to grab top edge of sheet. (FIG. 17)
6. Engage Carrier Adapter Arm Latches (50) to latch top Gripper Assembly at this position.
7. Now pivot sheet until Carrier Detent (44) latches. Sheet is now held firm by Gripper assemblies and is ready to be raised. (FIG. 17)
8. Using Carrier Lift Handles (42), pivot sheet upward, over your head. Said Utility Lift will pivot on its weighted, non-slip Rubber Covered Pivotal Base (25).
9. When sheet is in position overhead, rotate Tri-Pod Lock Handle (61) to a downward direction to unlatch or release Tri-Pod Support Assembly which will now provide support for said Utility Lift and supported building material. Note: If installing sheet in narrow room, i.e.: a hallway, and interference with Tri-Pod Support Legs is experienced, re-adjust Tri-Pod Assembly by pulling-up on Tri-Pod Lock Collar Lift Wings (62), while Tri-Pod Lock Handle (61) is in the unlatched position. When Tri-Pod Assembly is correctly adjusted for narrow area, rotate Tri-Pod Lock Handle (61) in an upward direction to latch Tri-Pod Assembly at this new setting.
10. Sheet is now fully supported. Raise sheet by hand or using the Manual Jacking mechanism (36) to a height that will facilitate transporting the sheet to where it will be installed. Depress Retractable Caster Pedal Latch (31) down and inward to lower and latch the Retractable Caster (28) housed in said Pivotal Base section. (FIG. 12)
11. When sheet is positioned correctly under place of install, depress the Retractable Caster Pedal Latch (31) down and outward to release the Retractable Caster (28) and lower the non-slip Pivot Base for firm support. Release Carrier Gripper Plates (45) by pulling on Carrier Detent (47) Release Lever chain. This last step will expose the sheet ends to allow for unobstructed butting or mating of material ends. (FIGS. 2 and 6)
12. Raise Panel or sheet to final install position while using Manual Jacking mechanism (36) to apply lifting and holding force, via Carrier Support Spring (43) to hold sheet in place. (FIG. 17) When sheet is positioned for final installation, fasten to building structure. Ensure sheet is fastened securely before lowering and removing said Utility Lifts.
13. The above procedure can be reversed to lower the sheet for re-fit or if additional trimming to accommodate a fixture, Etc. is necessary. See "Lowering said Utility Lift" procedure below.

Wall Installations (Sheet-Rock or Paneling):

1. Perform "Initial Set-Up" procedure. NOTE: Tri-Pods are not required for wall installations but can remain on said Utility Lift if previously fitted.
2. Set Carrier Detent Assembly (44) to the WALL position. (FIGS. 2 and 4) This will store the Carrier Detent away from the Lift Body. NOTE: Carrier Detent is not used for wall installations.
3. Ensure Lift is assembled correctly, with required number of Outer and Inner Lift Shaft extensions, to reach final installation height. Ensure said Utility Support Lift is fully collapsed.
4. Insert Wall Installation Plug (21) in any available Inner Lift Shaft Jacking Port (22) through opening for Manual Jacking Block (53). This restricts Inner Lift Shaft movements until a proper lifting angle is achieved.
5. Position Lifts in front of sheet-rock. (FIG. 18) Note: One Lift will work with thin or less than full size sheets. (See Note for Step-3 of Ceiling Installation.)
6. Adjust bottom Gripper Assembly (46) to center Carrier Assembly (35) on sheet to be installed. Engage Carrier Adapter Arm Latches (50) to latch bottom Gripper Assembly at this adjustment.
7. Place sheet on bottom Gripper Assembly (46) and lower Top Gripper Assembly (46) to grab top edge of sheet. (FIG. 18)
8. Engage Carrier Adapter Arm Latches (50) to latch top Gripper Assembly at this position.
9. Use Carrier Lift Handles (42) and said Utility Lift Body, as required, to raise sheet upward, keeping it against the wall as it is being raised. The Rubber Covered Pivotal Base (25) section will be pulled toward the wall as said Utility Lift and supported material is being raised. When a suitable angle of support is reached, approximately 60 degrees, (FIG. 18) remove the Wall Installation Plug and place in the Wall Installation Plug Storage (23) port, located in the Manual Jacking Block (53). If multiple said Utility Lifts are being used, raise sheet evenly by alternating these steps on both said Utility Lifts.
10. Release only the Top Grippers (46) by pulling Gripper Detent (47) chains. The top Carrier Grippers will pivot out and down, exposing the top sheet end to allow for butting. (FIGS. 18, 2 and 3)
11. Position sheet in final install position by using the Manual Jacking mechanism (36) to raise sheet. The weight of the material plus the pivot angle of said Utility Lift, will hold the sheet firmly in place. (FIG. 18)
12. The above procedure can be reversed to lower the sheet for re-fit or if additional trimming to accommodate a fixture, is necessary. See "Lowering and Removing said Utility Lift" procedure below. When sheet is positioned for final installation, fasten sheet to building structure. Ensure sheet is fastened securely before lowering and removing said Utility Lifts.

13. Perform "Lowering and Removing said Utility Lift" procedure.

Lowering and Removing said Utility Lift:

1. Reference FIGS. 7 and 9: Lightly apply downward pressure to Lift Detent Cam and Carrying Handle (37) until Inner Lift Shaft (FIG. 11) starts to lower. The rate at which the Inner Lift Shaft lowers is controlled by the Pneumatic Input/Output Port (30) adjustment. Maintain this downward pressure on the Detent Cam until said Utility Lift is fully collapsed. NOTE: If building material is presently being supported by said Utility Lift, ensure Pneumatic Input-/Output Port (30) is set to desired opening to control Inner Lift Shaft descent rate. Maintain light downward pressure on the Detent Cam until supported building material has been lowered to the described height for rework, removal or repositioning. Return to install activity descriptions.
2. If Tri-Pod is extended, use Tri-Pod Lock Collar Lift Wings (62) to raise the Tri-Pod Assembly up to the Latched position and rotate Tri-Pod Lock Handle (61) upward to lock or latch in place.
3. Reference FIG. 2: Release Carrier Detent by operating the Carrier Detent Release Lever (49) and pivot the Carrier Assembly clockwise, to its storage position. Carry said Utility Lift from installation zone using the Lift Detent Cam and Carrying Handle (37).
4. Add sheet fasteners, as required, where access was restricted by said Utility Lift's Carrier Assembly.

SUMMARY, RAMIFICATIONS AND SCOPE:

This versatile, user friendly Lift is compact, light weight, portable, collapsible and useful for many installation activities. The Lift Body has few moving parts which avoids operator complications and is easy to use and maintain. Said Lift can be used with pneumatic equipment. It is excellent for one or two person applications depending on physical and time oriented constraints of the job where used, by experienced tradesman or homeowners.

None of the prior art researched by me, had all of the said Utility Lift's features and many had only one available feature, over-head support for panel type materials. Most prior art appeared to be big, complex, heavy and required large operational floor space, without providing function, packaging, operator assist capabilities or versatility, in their entirety, as did the Versatile, Movable Panel and Utility Support Lift.

A Versatile, Movable Panel and Utility Support Lift consists of the following:

1. A spring cushioned positive grip non-slip adjustable Carrier Assembly.
2. Tubular sections used to assemble the inner and outer telescoping sections of said Utility Lift.
3. Tri-Pod Lock and Pivot assemblies, Tri-Pod Leg Support Limiter Links, support leg tubes and end tubes containing adjustable casters.
4. A weighted non-slip rubber covered Base section, which will not damage flooring, containing a pneumatic port, a retractable caster and a Tri-Pod anchor flange.
5. A Control section which contains the Lift Detent Cam with Carrying Handle plus the Manual Jacking mechanism.
6. Panel or Sheet Rock, Pipe or Beam Support and General Utility Support adapters to be used with the Carrier Assembly.
7. Pneumatic coupling, hose and flow valve assembly.
8. Posi-Lock Collar.
9. Carrying case, approximately 12"×12"×4' long, made from high impact plastic or vinyl.

The Versatile, Movable Panel or Utility Support Lift is designed to assist the operator in performing various installation activities. Full-feature configurations can be used to support various building materials to be fastened temporarily or permanently, to support structures. Some of these install activities are: A. Panel (i.e.: Sheet-Rock) installation on flat or sloped ceilings and walls. B. Plumbing (i.e.: Pipe run supports) C. Ceiling tile installations where an elevated material supply platform is required. D. Electrical ceiling fixture support. (i.e.: 2'×4' recessed ceiling light fixtures) E. Heating and Air-Conditioning duct or register installations. F. Overhead Cabinet or storage installations for kitchens, office and commercial applications.

It is designed to assist the operator in controlling and initially lifting sheet materials as well as supporting and raising these materials, quickly, to a desired height. The Base is equipped with a retracting, jackable caster to function with the Tri-Pod legs, which also contain casters, for moving the supported material from supply point to install point. It can be used to lower said building materials quickly and easily for removal or rework or refit applications.

The various Carrier adapters are easily installed and adjustable to facilitate a wide range of material sizes and shapes. Additional adapters could be designed, as required, for specific building material or item support and handling. Said Utility Lifts are designed to reach (Carrier pivot centerline) heights from approximately 1 meter to 4 meters. The Tri-Pod supports are also adjustable to provide said Utility Lifts with ample support at any height, from 1 meter, for cabinet installs, to the maximum height of approximately 4 meters. This Tri-Pod height adjustment ability plus the positioning capabilities are useful in allowing for base to wall clearance and other obstruction problems.

The supported building materials can be manually raised by hand. The operator would apply lifting pressure on Carrier Lift Handles, Inner Lift Shaft or by using the Manual Jacking mechanism. A pneumatic port is available on the Base section which is designed to work with a portable Air-Compressor, the types commonly used for air tools on most construction sites. A pneumatic coupling hose and valve assembly will be available to apply even (adjustable) pneumatic pressure to multiple Lifts simultaneously. In addition, said coupling valve will be capable of allowing the Lifts to be lowered, for rework, refit or removal, simultaneously. Manual intervention is required, at all times to overcome defaulted positive retention or detenting force, for lowering said Utility Lift's Inner Lift Shaft, with or without supported material being present on the Carrier Assembly. The descent or lowering rate is controlled by the adjustable Air-Escape valve mounted on said Utility Lift's Base or the pneumatic coupling hose valve assembly.

Said Utility Lifts are assembled or disassembled by screwing or unscrewing the Outer Lift Shaft sections. Tri-Pod Support Legs are also assembled by screwing them into the respective detentable coupling, until detent locks. To disassemble Tri-Pod Support Legs, lift-up on the detent to enable said Legs to be unscrewed. The Inner Lift Shafts are joined by sliding the open end of the shaft, with Jacking Ports aligned, over the coupling tube end and rotating slightly until spring loaded couplings, located in coupling tube, expand into its appropriate locking port. To disassemble said Legs, press-in on spring loaded couplings to release Inner Lift Shaft sections.

The Tri-Pod Pivot and Locking Collar assemblies are installed or removed by sliding on or off the Outer Lift shaft. Once positioned on said Utility Lift, a Tri-Pod Lock Handle is provided to lock the assembly in open-/extended or closed/latched positions. The Posi-Lock Collar is used to hold the Inner Lift Shaft in its final adjusted position when supporting heavy loads for long periods of time. (i.e.: Plumbing drain pipe or bundles of ceiling tiles.)

The entire said Utility Lift assembly is intended to be stored and transported in a carrying case which will have additional storage space for miscellaneous hand tools, e.g.: Fasteners, Drill, Screw-Gun, Trowels-Etc.

I claim:

1. A construction material handling apparatus comprising:

a base having a non-slip exterior surface, said base including a hemispherical bottom portion, the mass constituting said base being distributed so that said base rights itself after being tipped;

an extensible shaft means mounted on said base;

control means for lengthening and shortening said shaft means; and a carrier assembly secured to said shaft means for holding construction material.

2. The apparatus according to claim 1 wherein said carrier assembly is adjustable transversely of said shaft means.

3. The apparatus according to claim 1 wherein said carrier assembly has an adjustable stop and is pivotable relative to said shaft means from said adjustable stop.

4. The apparatus according to claim 1 including releasable gripper means for holding the construction material on said assembly.

5. The apparatus according to claim 1 wherein said control means includes a one way clutch for lengthening said shaft means by hand without collapse.

6. The apparatus according to claim 1 wherein said control means includes jacking means for lengthening said shaft means, incrementally, to bring construction material in closer proximity to a building frame.

7. The apparatus according to claim 1 including spring tension means for urging carried construction material in contact with a building frame.

8. The apparatus according to claim 1 including controllable means for dampening shaft means movement during shortening.

9. The apparatus according to claim 1 including a tripod mechanism having legs extendable outwardly of said shaft means for additional support for said apparatus.

10. The apparatus according to claim 9 wherein said tripod legs are adjustable in length.

11. The apparatus according to claim 9 wherein said tripod legs have feet with casters extending therefrom and said base has a retractable caster housed therein, said tripod and base casters to facilitate movement of said apparatus across a floor surface.

* * * * *